US006235351B1

(12) United States Patent
DiMarzio et al.

(10) Patent No.: US 6,235,351 B1
(45) Date of Patent: May 22, 2001

(54) METHOD FOR PRODUCING A SELF DECONTAMINATING SURFACE

(75) Inventors: Donald DiMarzio, Northport; Ronald G. Pirich, Islip; John F. Klein, Port Washington, all of NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/235,969

(22) Filed: Jan. 22, 1999

(51) Int. Cl.[7] ..... C23C 4/10; A62D 3/00

(52) U.S. Cl. ..... 427/453; 427/595; 427/597; 427/576; 427/446; 588/200

(58) Field of Search ..... 588/200; 427/576, 427/453, 446, 448, 454, 595, 597

(56) References Cited

U.S. PATENT DOCUMENTS

| | | | | |
|---|---|---|---|---|
| 2,718,473 | | 9/1955 | Powers | 117/49 |
| 3,944,683 | | 3/1976 | Church et al. | 427/34 |
| 4,713,646 | | 12/1987 | Sunano et al. | 338/34 |
| 5,707,915 | | 1/1998 | Taoda | 502/159 |
| 5,939,146 | * | 8/1999 | Lavernia | 427/446 |
| 5,952,040 | * | 9/1999 | Yadav et al. | 427/126.3 |
| 5,990,373 | * | 11/1999 | Klabunde | 588/200 |
| 5,997,956 | * | 12/1999 | Hunt et al. | 427/450 |
| 6,025,034 | * | 2/2000 | Strutt et al. | 427/450 |
| 6,057,488 | * | 5/2000 | Koper et al. | 588/200 |

* cited by examiner

*Primary Examiner*—Shrive Beck
*Assistant Examiner*—Jennifer Kolb
(74) *Attorney, Agent, or Firm*—Terry J. Anderson; Karl J. Hoch, Jr.

(57) ABSTRACT

A method for producing a self decontaminating surface to decontaminate chemical and biological contaminants that are deposited on the surface and decontaminatable through reaction with free hydroxyl radicals. The method first includes determination of a surface to be treated and which is exposable to ultraviolet light. Second, a coating of nanoparticles of a transition metal oxide, non-limitedly exemplified by anatase titanium dioxide, is applied to the chosen surface. Application of the coating is accomplished by spraying heated nanoparticles or clusters thereof from a feed stock onto the surface to form a nanoparticle coating, with the nanoparticles being at a temperature of at least about 750° C. upon exit from a spray apparatus and of a size between about 5 nm and 100 nm. Finally, the treated surface is exposed to ultraviolet light and water moisture, either naturally from the environment or artifically, to thereby catalytically form free hydroxyl radicals that thereafter react with the contaminants to render them generally harmless.

6 Claims, 1 Drawing Sheet

METHOD FOR PRODUCING A SELF DECONTAMINATING SURFACE

FIELD OF THE INVENTION

The present invention relates to the treatment of hazardous contamination in general, and in particular to thermal-spray surface-deposition methodology for the production of a self-decontaminating photocatalytic surface capable of neutralizing hazardous organic chemicals and biologicals through reaction with hydroxyl radicals produced from the interaction of a transition metal oxide and water in the presence of ultraviolet light.

BACKGROUND OF THE INVENTION

Contamination of exposed structural surfaces with dangerous chemical or biological material creates a critical threat in both civilian and military contexts. In the former context, such civilian contamination can occur accidentally, such as during the conveyance of hazardous materials from one site to another, or the civilian contamination can occur on purpose, such as where a community becomes the target of hostility. In the military context, chemical and/or biological warfare can, for instance, occur under test conditions, or it can be present as an actual peril during active conflict. In any event, such deployed materials can remain for a significant period of time (e.g. up to several weeks) on exposed surfaces such as vehicles, aircraft, buildings, equipment, etc., and thereby remain as dangers to humans and animals that may come in contact with these surfaces before decontamination is undertaken.

One present decontamination procedure includes the application of cleaning agents generally coupled with actual scrubbing of surfaces. Because of the nature of the contaminants, extreme care must be taken to make certain that any water supply systems, as well as fisheries, domestic and wild animal water sources, and the like, do not become infiltrated because contaminated cleaning agents are rinsed into the sewer system or ground and eventually return in supposedly fresh water for subsequent consumption. A second present decontamination procedure is the application of a fixed coating of titanium dioxide nanoparticles on an exposed surface for subsequent decontamination through ultraviolet catalytic generation of hydroxyl radicals. However, and while such a coating is effective in achieving decontamination, its universality of application under present methodology is severely limited because coating procedures presently taught do not result in efficient, uniform, and rapid particulate deposition.

Thus, in view of the criticality of adequate care and the danger present in exercising that care when dealing with hazardous chemicals and biologicals, it is apparent that a need is present for methodology that can accomplish decontamination of these hazardous substances without severe interference with normal societal activities. Accordingly, a primary object of the present invention is to provide methodology for creating a self decontaminating surface whereby a transition metal oxide can be efficiently and relatively widely deposited on a surface for subsequent reaction with water and catalytic ultraviolet light to yield hydroxyl radicals for decontaminating reaction with untoward contaminants.

Another object of the present invention is to provide deposition methodology that employs a thermal spray technique for coating transition metal oxide on a surface for subsequent decontamination.

Yet another object of the present invention is to provide deposition methodology for nanoparticle cluster impact of the transition metal oxide on the surface whereby the clusters break apart on impact to cause particle dispersion and adherence at the surface interface.

These and other objects of the present invention will become apparent throughout the description of the invention which now follows.

SUMMARY OF THE INVENTION

The present invention is a method for producing a self decontaminating surface to decontaminate chemical and biological contaminants that are decontaminatable through reaction with free hydroxyl radicals and that are deposited on the surface. The method first includes the determination of a surface to be treated and which is disposed to be exposable to ultraviolet light. Second, a coating of nanoparticles of a transition metal oxide, non-limitedly exemplified by anatase titanium dioxide, is applied to the chosen surface. Application of the coating is accomplished by spraying heated nanoparticles of the transition metal oxide from a feed stock onto the surface to form a nanoparticle coating, with the nanoparticles being at a temperature of at least about 750° C. upon exit from a spray apparatus and of a size between about 5 nm and 100 nm. Finally, the treated surface is exposed to ultraviolet light and water moisture to thereby catalytically form free hydroxyl radicals that thereafter react with the contaminants to render them generally harmless.

Generally, any surface can be established as a self decontaminating surface, and can include building structures, ships, aircraft, etc. such as those that may be involved in military operations where hazardous chemicals (e.g. solvents, nerve gases) and/or biologicals (e.g. bacteria, viruses) are potentially involved. A usual source of ultraviolet light is from sunlight, while a usual source of moisture is from ambient humidity. One non-limiting method for applying a nanoparticle coating is spraying a plurality of nanoparticle clusters onto the surface. These sprayed clusters strike the surface and immediately break apart to thereby provide relatively uniform nanoparticle surface coverage. Reaction between metal oxide molecules and water molecules, catalyzed by ultraviolet light, results in the liberation of free hydroxyl radicals available for decontamination reaction with chemical and biological contaminants to thereby render the surface safe. In this manner, exposed structural surfaces can be rapidly converted to self decontaminating surfaces that render innocuous the untoward chemical and biological precipitates there deposited.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
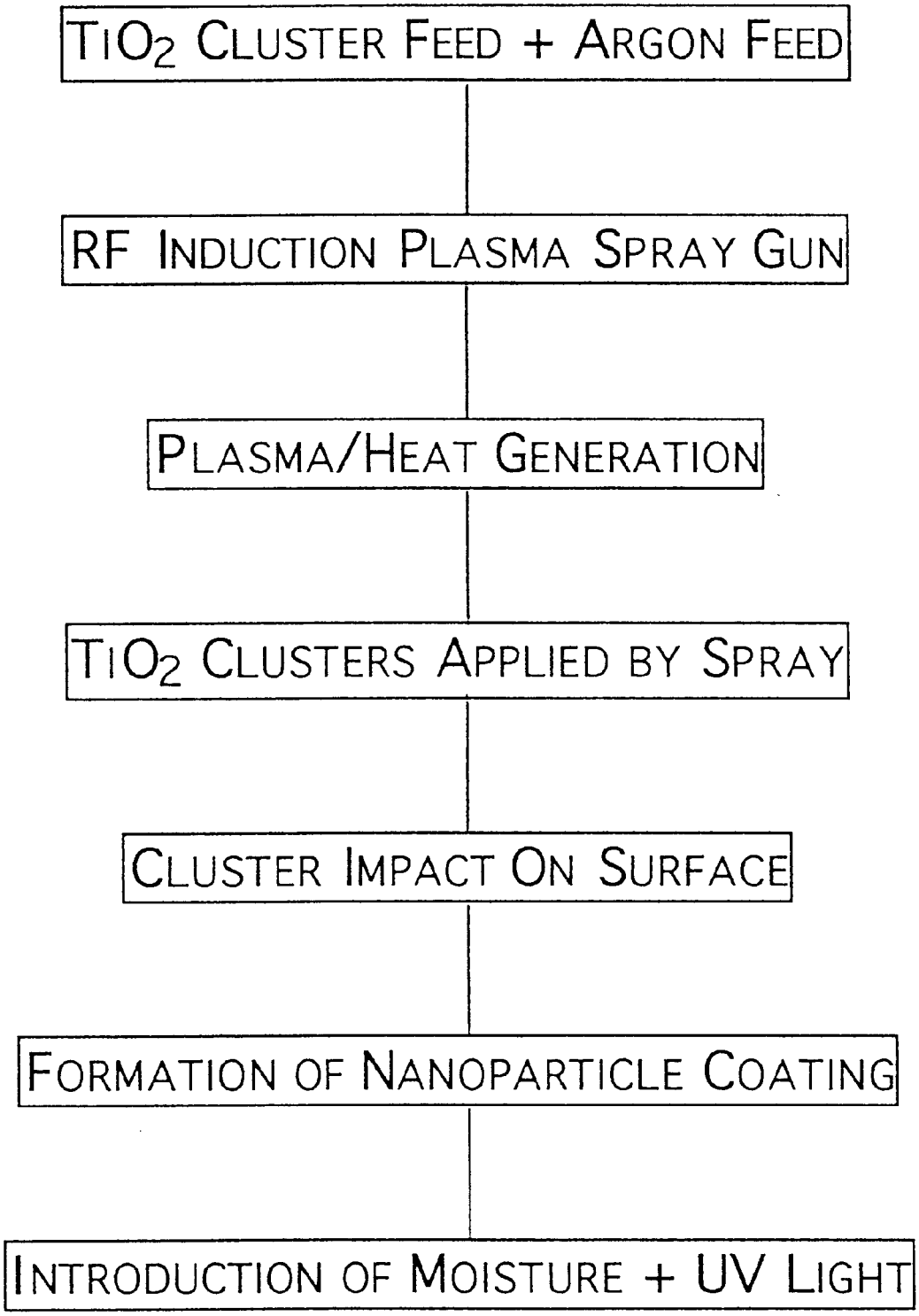
FIG. 1 is a block diagram illustrating the treatment of a surface to render the surface self decontaminating.

The present invention provides methodology for rendering a surface self decontaminating with respect to chemical and biological contaminants. Non-limiting exemplary surfaces include building exteriors, ship decks and exposed hull portions, aircraft wings and fuselages, etc. Such self decontaminating is achieved in the presently preferred embodiment, as illustrated in the diagram of FIG. 1, by first providing clusters of anatase titanium dioxide nanosized particles in an alcohol suspension. This suspension then is fed into an axial feed RF induction plasma spray gun along with an argon carrier gas. The RF power generates an argon plasma which heats the titanium dioxide clusters to a temperature of about 1,000° C. These heated clusters then are accelerated to velocities from about 100 to 300 meters per second and delivered to the surface to be coated. Upon impacting the surface, cluster break-up occurs to thereby uniformly distribute and adhere nanoparticles (e.g. 5 to 50 nm) of titanium dioxide on the surface. A coating of a few (e.g. 5 to 15) micrometers is preferred to thereby be of a sufficient quantity for self decontamination.

As earlier related, in order to achieve surface decontamination properties, the coated titanium dioxide requires two additional components: water moisture and ultraviolet light. Both of these additional components typically are supplied by the environment through ambient humidity and sunlight, respectively. Thus, when a humidity-exposed outdoor surface bearing the coating of titanium dioxide is exposed to natural sunlight, photocatalysis proceeds to produce free hydroxyl ($^{-}OH$) groups capable of reacting with, and thereby decontaminating, untoward chemical and biological contaminants. Of course, when ultraviolet light and/or water moisture sourcing is not available naturally, ambient conditions can be replicated as necessary and practical to thereby artificially produce a self decontaminating surface.

Through implementation of the methodology defined and described herein, a user is able to effectuate a safe environment with respect to surface interactions with personnel who come in contact with such a treated surface during the shelf life of hydroxyl radicals associated with that surface. Thus, while an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method for producing a self decontaminating surface to decontaminate chemical and biological contaminants so decontaminatable through reaction with free hydroxyl radicals and deposited on said surface, the method comprising:

a) identifying a contaminateable surface exposable to ultraviolet light;

b) spraying a plurality of heated nanoparticle clusters of transition metal oxide impact-dispersing nanoparticles from a feed stock onto said surface at a velocity sufficient to break said clusters apart upon impact with said surface for forming a nanoparticle coating on said surface, said nanoparticles being at a temperature of at least about 750° C. and of a size between about 5 nm and 100 nm; and c) exposing said nanoparticle coating on said surface to water moisture and ultraviolet light for liberating free hydroxyl radicals for reacting with and decontaminating contaminants in contact with said coating.

2. A method for producing a self decontaminating surface as claimed in claim 1 wherein said heated nanoparticles of said nanoparticle clusters are generally molten and splatter and solidify on said surface to provide a nanoparticle coating thereon.

3. A method for producing a self decontaminating surface as claimed in claim 1 wherein said water moisture is provided by ambient humidity and said ultraviolet light is provided by sunlight.

4. A method for producing a self decontaminating surface to decontaminate chemical and biological contaminants so decontaminatable through reaction with free hydroxyl radicals and deposited on said surface, the method comprising:

a) identifying a contaminateable surface exposable to ultraviolet light;

b) spraying a plurality of heated nanoparticle clusters of anatase titanium dioxide impact-dispersing nanoparticles from a feed stock onto said surface at a velocity sufficient to break said clusters apart upon impact with said surface for forming a nanoparticle coating on said surface, said nanoparticles being at a temperature of at least about 750° C. and of a size between about 5 nm and 100 nm; and c) exposing said nanoparticle coating on said surface to water moisture and ultraviolet light for liberating free hydroxyl radicals for reacting with and decontaminating contaminants in contact with said coating.

5. A method for producing a self decontaminating surface as claimed in claim 4 wherein said heated nanoparticles of said nanoparticle clusters are generally molten and splatter and solidify on said surface to provide a nanoparticle coating thereon.

6. A method for producing a self decontaminating surface as claimed in claim 4 wherein said water moisture is provided by ambient humidity and said ultraviolet light is provided by sunlight.

* * * * *